US011304574B1

(12) United States Patent
King

(10) Patent No.: US 11,304,574 B1
(45) Date of Patent: Apr. 19, 2022

(54) BEDPAN CUSHION

(71) Applicant: Princess D. King, Jacksonville, FL (US)

(72) Inventor: Princess D. King, Jacksonville, FL (US)

( * ) Notice: Subject to any disclaimer, the term of this patent is extended or adjusted under 35 U.S.C. 154(b) by 0 days.

(21) Appl. No.: 17/036,099

(22) Filed: Sep. 29, 2020

(51) Int. Cl.
*A47K 13/26* (2006.01)
*A47K 11/04* (2006.01)

(52) U.S. Cl.
CPC ..... *A47K 13/26* (2013.01); *A47K 11/04* (2013.01)

(58) Field of Classification Search
CPC ..... A47K 13/26
USPC ..... 4/456, 450, 457, 449, 458, 222, 464
See application file for complete search history.

(56) References Cited

U.S. PATENT DOCUMENTS 2,260,437 A * 10/1941 Chambers ..... A47K 13/00 5/653
2,481,427 A * 9/1949 Hunter ..... A61G 9/003 4/456
2,501,844 A * 3/1950 Ervin ..... A61G 9/003 4/456
2,817,093 A * 12/1957 Rode ..... A61G 9/003 4/456
2,886,827 A * 5/1959 Washington ..... A61G 9/003 4/456
3,100,303 A * 8/1963 Coulter ..... A61G 9/003 4/456
3,514,793 A * 6/1970 West ..... B63C 9/30 4/456
3,597,771 A * 8/1971 Rickmeier, Jr. ..... A61G 9/003 4/450
3,939,502 A * 2/1976 Miller ..... A61G 9/003 4/456
4,759,086 A * 7/1988 Booth-Cox ..... A61G 5/1002 4/451
4,827,540 A * 5/1989 Stokes ..... A61G 9/003 4/451
5,079,788 A * 1/1992 Raupp ..... A61G 9/003 4/450
5,867,845 A * 2/1999 Fangmann ..... A61G 9/003 4/456
7,891,029 B2 * 2/2011 Mosier ..... A61G 9/003 4/450
8,453,274 B1 * 6/2013 Olmstead ..... A61G 9/003 4/456
10,682,025 B2 * 6/2020 Rudolph ..... A47K 11/12
2010/0183814 A1 * 7/2010 Rios ..... C08J 7/046 427/387

(Continued)

*Primary Examiner* — Lori L Baker
(74) *Attorney, Agent, or Firm* — Sanchelima & Associates, P.A.; Christian Sanchelima; Jesus Sanchelima

(57) ABSTRACT

A system for a seat cushion including a cushion assembly and a seat assembly is disclosed. The seat cushion includes a cushion that is circular, or horseshoe shaped. The seat cushion is filled with a gel shock absorbing material to provide comfort to a user sitting on the cushion for prolonged periods of time. The cushion is removably mounted to a bedpan, a commode, a commode seat or a toilet seat. The cushion includes front dual attachment straps to secure the cushion to the bedpan or the commode. The dual attachment straps include openings to be engaged by a fastening member on an opposite one of dual attachment straps. The cushion is easily cleaned once removed from the bedpan or the commode.

13 Claims, 4 Drawing Sheets

(56) References Cited

U.S. PATENT DOCUMENTS

| | | | | |
|---|---|---|---|---|
| 2016/0007671 | A1* | 1/2016 | Prust | A47C 27/007 2/411 |
| 2019/0282042 | A1* | 9/2019 | Nye | A47K 11/04 |

* cited by examiner

BEDPAN CUSHION

BACKGROUND OF THE INVENTION

1. Field of the Invention

The present invention relates to cushion and, more particularly, to a cushion that is removably mounted to a bedpan, commode or toilet seat that provides comfort to a user sitting for prolonged periods of time.

2. Description of the Related Art

Several designs for bedpan cushions have been designed in the past. None of them, however, include a ring or horseshoe shaped bed pan cushion which is filled with a shock absorbing gel material and has dual attachment straps. The cushion may also be mounted to a commode or other similar toilet seats to provide comfort to the user. The added comfort is evident upon seating on the bedpan, commode, toilet seat or the like after a prolonged period of time.

Applicant believes that a related reference corresponds to U.S. Pat. No. 5,079,788 for a cushioned contoured bedpan. Applicant believes another related reference corresponds with U.S. Pat. No. 3,939,502 for a disposable pan for a bedpan which includes attachment loops. None of these references, however, teach of cushion that is removably mounted to a bedpan or a commode, with dual attachment straps, that includes a shock absorbing gel that can provide comfort to the user sitting for prolonged periods of time.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a cushion that is removably mounted to a commode, bedpan, or toilet seat.

It is another object of this invention to provide a cushion that provides comfort to a user sitting on a commode, bedpan or toilet seat.

It is still another object of the present invention to provide a cushion that can be easily removed for easy cleaning and sanitization thereof.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
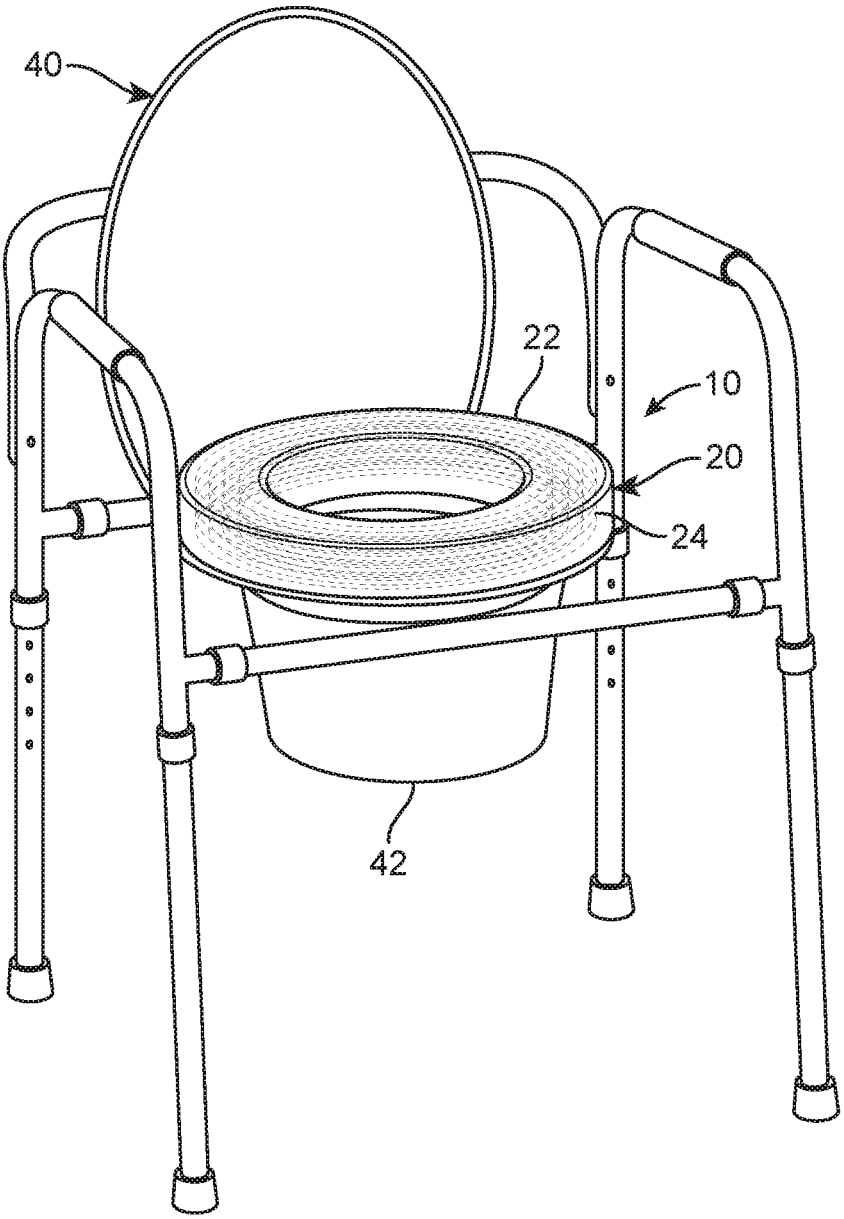
FIG. 1 represents the present invention is an operational setting in which a user is sitting on a commode 42 in comfort because of the present invention.

Referring now to the drawings, where the present invention is generally referred to with numeral 10, it can be observed that it, seat cushion 10, basically includes a cushion assembly 20 and a seating assembly 40.

Figure 2:
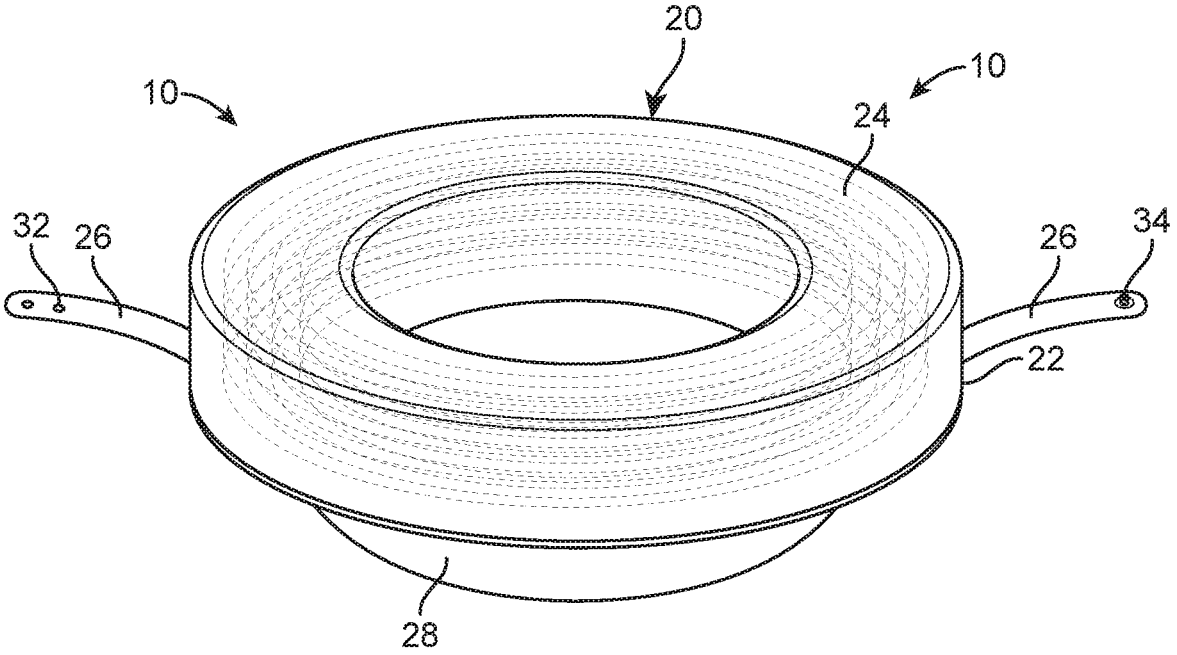
FIG. 2 shows an isometric view of the ring cushion 22, in accordance with an embodiment of the present invention.
Figure 3:
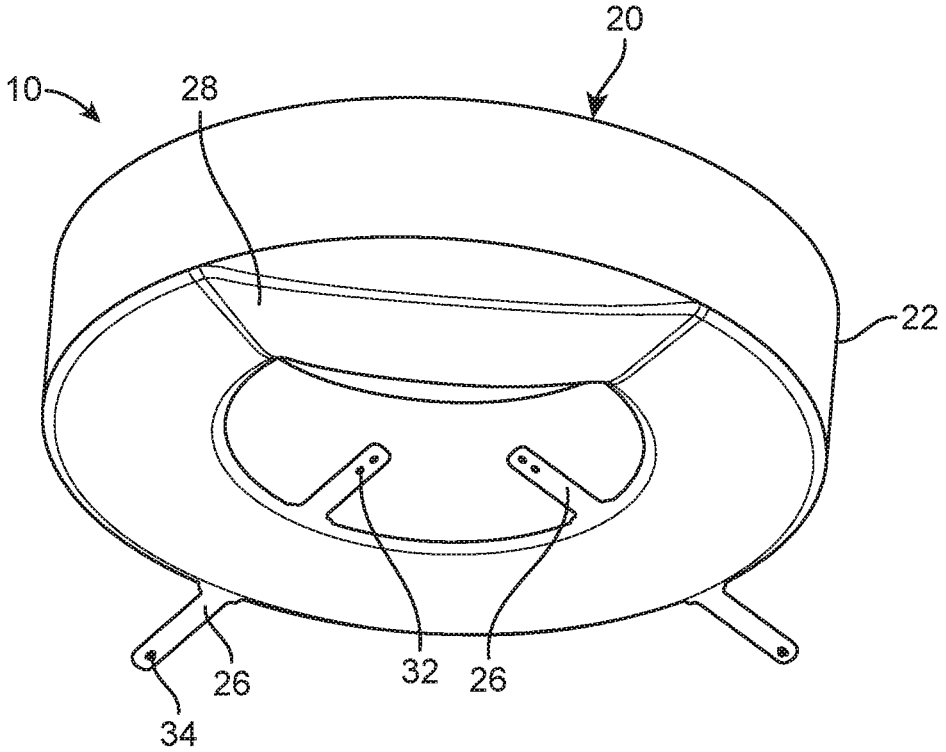
FIG. 3 represents a bottom view of the ring cushion 22 removably mounted to a commode 42 with front straps 26 and a sleeve 28.
Figure 4:
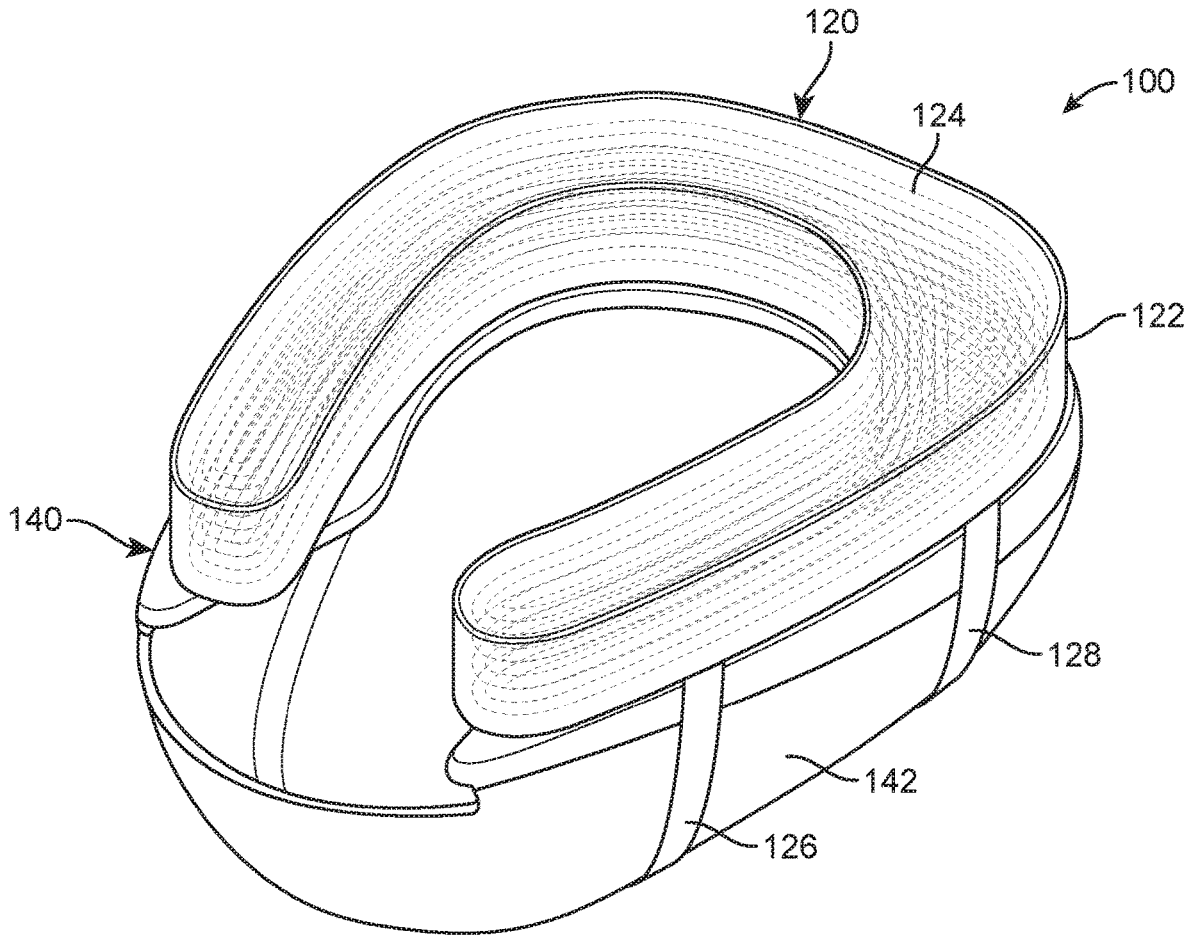
FIG. 4 illustrates the present invention, in an alternate embodiment, in an operational setting in which a user is sitting on a bedpan 142 in comfort because of the present invention.
Figure 5:
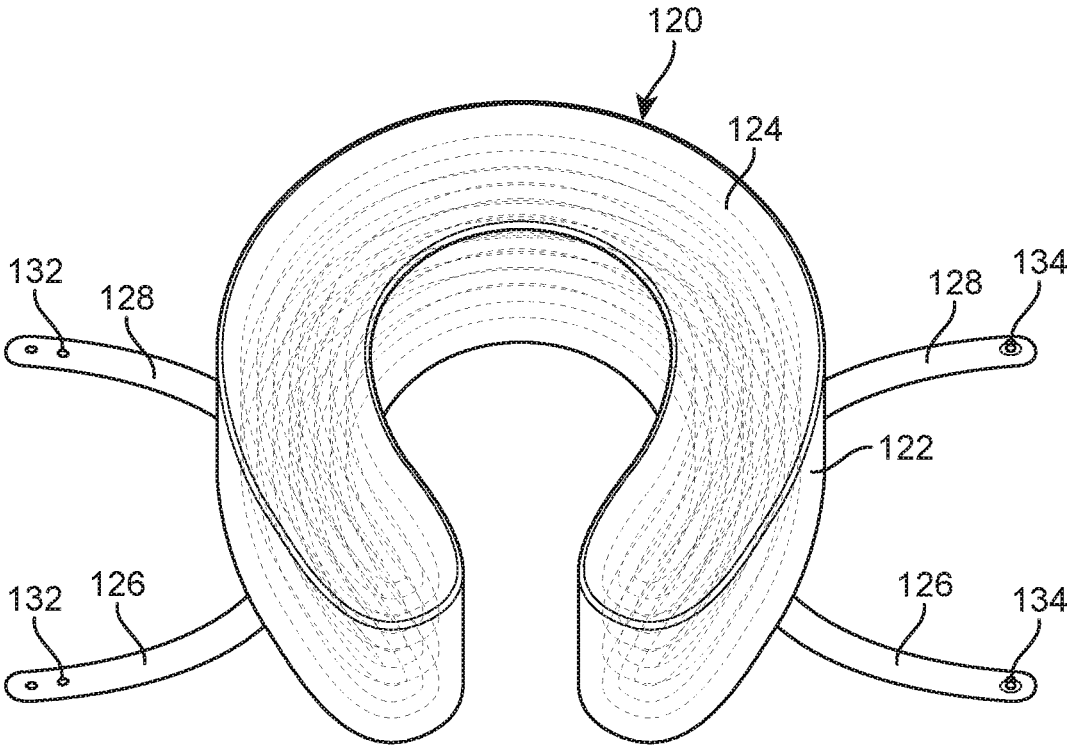
FIG. 5 is a representation of an isometric view of the horseshoe cushion 122, in accordance with an alternate embodiment of the present invention.

The present invention, in one embodiment, can be seen depicted in FIG. 1-FIG. 3. It can be seen that seat cushion 10 includes cushion assembly 20 which includes a ring cushion 22 that may be filled with a shock absorbing material 24. It should be understood that cushion assembly 20 may cooperate with seating assembly 40. More specifically, seating assembly 40 may include a commode 42 to which ring cushion 22 may be removably mounted thereto. Commode 42 may include a lid and a commode seat. It should be understood that when it is indicated that the present invention is mounted to commode 42 it refers to the seat of commode 42. It can be appreciated that ring cushion 22 may be made of silicone, rubber, plastic or other suitable materials. Ring cushion 22 may be intended to be seated on for prolonged periods of time and should be of materials that are comfortable and possibly may not generate heat. Ring cushion 22 may be plush and soft. It should be understood that ring cushion 22 may be of predetermined dimensions that cooperate with the dimensions of commode 42. The present invention may be retrofitted onto already existing commodes, toilet seats or the like. Preferably, ring cushion 22 may be circular in shape, however, ring cushion 22 may be other predetermined shapes that cooperate with fitting on commode 42. Ring cushion 22 may include a central opening that allows for the buttock of a person to comfortably sit on for proper defecation into commode 42. Shock absorbing material 24 may fill ring cushion 22. Preferably, shock absorbing material 24 may be a gel. However, it may be suitable for shock absorbing material 24 to be other materials that provide comfort to a user sitting on ring cushion 22 for extended periods of time. Other materials that may be suitable for shock absorbing material 24 may be foam, cotton, plastic, memory foam or the like.

The present invention may include means that allow for removably being mounted to commodes, toilet seats, or commode seats. To allow for the present invention to be removably mounted to commode 42 ring cushion 22 may include straps 26 be mounted to the lateral sides of ring cushion 22 at a rear end thereof. One of straps 26 may include openings 32. An opposite of straps 26 may include a fastening member 34. Fastening member 34 may protrude outwardly from straps 26 mounted thereto. As seen in FIG. 3 it may be seen how openings 32 on straps 26 may be engaged by fastening member 34 on another of straps 26 to secure ring cushion 22 to commode 42 or commode seat. The securement of straps 26 occurs on an underside of commode 42. Fastening member 34 may be inserted through one of openings 32. Preferably, straps 26 may be made of silicone or the like to for easy cleaning and sanitization thereof. It may be suitable for straps 26 to be secured together by other means such as hook and loop straps, screws, fasteners, snap buttons, buttons, adhesives, or the like. In an alternate embodiment, straps 26 may be integral with ring cushion 22. It may be suitable for straps 26 to be of predetermined dimensions for easy and secure engagement of each other. Straps 26 may have similar shapes to each other with rounded distal ends. Straps 26 may also suitably be referred to as dual attachment straps. Straps 26 may secure the rear of cushion 22 to commode 42. To secure the front of cushion 22 to the front of commode 42 a sleeve 28 may be used. Sleeve 28 may be located at a front underside of cushion 22. Sleeve 28 may extend a partial length of cushion 22. Sleeve 28 may be open on one side. Sleeve 28 may be open on the side facing straps 26, in the preferred embodiment. Sleeve 28 may slip over and under the front of commode 42 to secure cushion to commode 42. Straps 26 may secure the rear of cushion 22 to commode and sleeve 28 may secure the front of cushion 22 to commode 42.

In an alternate embodiment, the present invention may include a seat cushion 100. It can be seen that seat cushion 100 includes cushion assembly 120 which includes a horseshoe cushion 122 that may be filled with a shock absorbing material 124. It should be understood that cushion assembly 120 may cooperate with seating assembly 140. More specifically, seating assembly 140 may include a bedpan 142 to which horseshoe cushion 122 may be removably mounted thereto. It should be understood that seat cushion 100 may be similar to seat cushion 10 but better suited to be mounted to bedpans. It can be appreciated that horseshoe cushion 122 may be made of silicone, rubber, plastic or other suitable materials. Horseshoe cushion 122 may be intended to be seated on for prolonged periods of time and should be of materials that are comfortable. It may be suitable for horseshoe cushion 122 to be plush and soft. Preferably, the materials also do not generate much heat. It should be understood that horseshoe cushion 122 may be of predetermined dimensions that cooperate with the dimensions of bedpan 142. The present invention may be retrofitted onto already existing bedpans. Preferably, horseshoe cushion 122 may be shaped like a horseshoe or U-shaped to allow for fitting properly on bedpan 142. Horseshoe cushion 122 may have an opening at a front end, that leads to a central opening of horseshoe cushion 122. However, horseshoe cushion 122 may be other predetermined shapes that cooperate with fitting on bedpan 142. Shock absorbing material 124 may fill horseshoe cushion 122. Preferably, shock absorbing material 124 may be a gel. However, it may be suitable for shock absorbing material 124 to be other materials that provide comfort to a user sitting on horseshoe cushion 22 for extended periods of time. Other materials that may be suitable for shock absorbing material 124 may be foam, cotton, plastic, memory foam or the like.

Seat cushion 100 may include means that allow for removably being mounted to bedpans. To allow for the seat cushion 100 to be removably mounted to bedpan 142 horseshoe cushion 22 may include front straps 126 and rear straps 128 that may be mounted to the lateral sides of horseshoe cushion 122 at a front end and rear end thereof, respectively. One of front straps 126 and one of rear straps 128, preferably being on a same lateral side, may include openings 132. An opposite of front straps 126 and rear straps 128 may each include a fastening member 134. Fastening member 134 may protrude outwardly from front straps 126 and rear straps 128 mounted thereto. Similar to what is depicted in FIG. 3, it may be seen how openings 132 on front straps 126 and rear straps 128 may each be engaged by fastening member 134 on front straps 126 and rear straps 128, respectively, to secure horseshoe cushion 122 to bedpan 142. The securement of front straps 126 and rear straps 128 occurs on an underside of bedpan 142. Fastening member 134 may be inserted through one of openings 132. Preferably, front straps 126 and rear straps 128 may be made of silicone or the like to for easy cleaning and sanitization thereof. It may be suitable for front straps 126 and rear straps 128 to be secured together by other means such as hook and loop straps, screws, fasteners, snap buttons, buttons, adhesives, or the like. In an alternate embodiment, front straps 126 and rear straps 128 may be integral with horseshoe cushion 122. It may be suitable for front straps 126 and rear straps 128 to be of predetermined dimensions for easy and secure engagement of one another. Front straps 126 and rear straps 128 may have similar shapes with rounded distal ends. Front straps 126 and rear straps 128 may be referred to as dual attachment straps.

It can be seen that the present invention may help to provide comfort to a user that is using the bathroom to relieve themselves. The present invention may reduce markings and uncomfortableness associated with typical bathroom seats. The present invention may be removably mounted to appropriate seats. The present invention may also be easily cleaned and sanitized. There is the added comfort resulting from the present invention being made of a material that does not stick to a user. The present invention may be reusable. Ring cushion 22 or horseshoe cushion 122 may be reusable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a cushion, comprising:

a cushion assembly having a ring cushion filled with a shock absorbing material, said ring cushion further including dual attachment straps, said cushion further includes a sleeve at a front underside of said cushion, said sleeve slipping over, engaging and covering a front portion of said commode to secure said cushion to said commode, said sleeve is open on a side facing said dual attachment straps;

a seating assembly including a commode; and said ring cushion removably mounted to said commode, said ring cushion secured to said commode with said dual attachment straps at an underside of said commode.

2. The system of claim 1, wherein said ring cushion is circular.

3. The system of claim 1, wherein said ring cushion includes a central opening.

4. The system of claim 1, wherein said ring cushion is reusable.

5. The system of claim 1, wherein said dual straps include openings and a fastening member to engage each other.

6. The system of claim 1, wherein said shock absorbing material is a gel material.

7. The system of claim 3, wherein some of said dual attachment straps extend into said central opening when said straps are detached from one another.

8. A system for a cushion, comprising:

a cushion assembly having a horseshoe cushion filled with a shock absorbing material, said horseshoe cushion further including dual attachment straps;

a seating assembly including a bedpan; and said horseshoe cushion removably mounted to said bedpan, said horseshoe cushion secured to said bedpan with said dual attachment straps at an underside of said bedpan, some of said dual attachment straps including openings and other of said dual attachment straps including a fastening member, said fastening member received by one of said openings to engage said dual attachment straps together when secured to said bedpan.

9. The system of claim 8, wherein said horseshoe cushion includes an opening at a front end thereof.

10. The system of claim 9, wherein said opening leads to a central opening of horseshoe cushion.

11. The system of claim 8, wherein said shock absorbing material is a gel material.

12. The system of claim 8, wherein said dual attachment straps extend from lateral sides of said cushion.

13. A system for a cushion, comprising:

a cushion assembly having a ring cushion filled with a shock absorbing gel material, said ring cushion having a central opening, said ring cushion including dual attachment straps and a sleeve, said dual attachment straps mounted on lateral sides of said ring cushion, wherein some of said dual attachment straps include a plurality of openings, wherein other of said dual attachment straps include a fastening member, said dual attachment straps engaging each other when said fastening member is secured through one of said openings, said dual attachment straps having rounded distal ends, said ring cushion includes two of said dual attachment straps at a rear lateral side of said cushion, said dual attachment straps extending into said central opening when released from one another, said sleeve being at a front bottom side of said cushion, said sleeve being open towards a side facing said dual attachment straps;

a seating assembly including a commode; and said ring cushion removably mounted to said commode with said dual attachment straps engaging one another at an underside of said commode, said sleeve engaging and covering a front of said commode.

* * * * *